US006295974B1

(12) United States Patent
McCants

(10) Patent No.: US 6,295,974 B1
(45) Date of Patent: Oct. 2, 2001

(54) ELECTRIC POWERED COMPRESSOR FOR MOTORCYCLE ENGINES

(76) Inventor: Dale A. McCants, 5363 Savannah Hwy., Ravenel, SC (US) 29470

( * ) Notice: Subject to any disclaimer, the term of this patent is extended or adjusted under 35 U.S.C. 154(b) by 0 days.

(21) Appl. No.: 08/822,942

(22) Filed: Mar. 21, 1997

(51) Int. Cl.[7] ..... F02B 39/10
(52) U.S. Cl. ..... 123/565
(58) Field of Search ..... 123/565; 417/362

(56) References Cited

U.S. PATENT DOCUMENTS 3,273,788 * 9/1966 Coward ..... 417/362
5,586,540 * 12/1996 Marzec et al. ..... 123/565

* cited by examiner

*Primary Examiner*—Michael Koczo
(74) *Attorney, Agent, or Firm*—B. Craig Killough

(57) ABSTRACT

An electric turbine installed between the air filter and carburetor of an internal combustion motorcycle engine for increasing intake air compression. The rotor is driven by an electric motor connected to the rotor by a belt driver. The electric motor power supply originates from electricity generated by the motorcycle alternator. The turbine rpm is regulated by the power supply voltage provided to the electric motor by a coil attachment to the motorcycle alternator.

10 Claims, 4 Drawing Sheets

ELECTRIC POWERED COMPRESSOR FOR MOTORCYCLE ENGINES

BACKGROUND OF THE INVENTION

1. Field of the Invention

The present invention relates to the field of compressors used in internal combustion engines and, more particularly, to a compressor powered by an electric motor designed especially for use in motorcycle engines.

2. Description of the Related Art

The use of a compressor for creating added power boost to a conventional internal combustion engines is well known in the prior art. The typical compressor used for internal combustion engines is designed as part of a turbocharger. The standard turbocharger consists of a compressor or rotor shaft driven by the exhaust gases of an internal combustion engine. The rotating exhaust compressor is connected to an internal intake air compressor which compresses the intake air entering the carburetor or cylinder prior to combustion. The richer mixture of air and fuel provides greater power to a standard internal combustion engine. Traditionally, the standard turbocharged assisted internal engine proves most effective at higher engine rpm ranges because of the lag effect created by the delay between throttle control and increased air compression created by the intake air compressor.

Much of the prior art turbochargers that incorporate the use of electric power is designed to address the lag effect found in a standard turbocharger engine. For example, U.S. Pat. No. 4,981,017 to Shinji Hara et al. is a compressor control system having a rotary electric motor mounted on the rotatable shaft. Before the motor vehicle is started, the electric motor is engaged providing a pressure boost to increase the response of acceleration when the accelerator pedal is depressed by the vehicle operator. After the engine has reached the appropriate rpm range, the exhaust compressor takes over the rotation of the intake air compressor.

U.S. Pat. No. 4,838,324 to Andreas Mayer is described as a free-running pressure wave supercharger for an internal combustion engine, especially designed for diesel engines. This supercharger is connected to the rotor shaft and is started by an electric motor. The function of the supercharger is to ensure a pressure wave process immediately after the diesel engine starts.

U.S. Pat. No. 5,088,286 to Hiroshi Muraji uses an electric motor to control and regulate a compressor system. The Muraji invention uses the turbo as a source of electricity generation and a means for controlling the speed of rotation of the compressors.

Although the prior art includes traditional turbocharged systems for use on motorcycles, the practical application of a turbocharger for a motorcycle is difficult given the limited space accommodations available on a motorcycle frame. Additionally, the prior art does not include a turbocharged engine system that operates solely by an electric means without the assistance of a exhaust driven compressor. The advantage of such a system is the facile packaging of such a unit on a the relatively small frame provided by both street motorcycles as well as off-road motorcycles.

The present invention differs from the existing art in that the internal air compressor intake is solely operated by an electric motor without any power assistance from exhaust gases. The compressor operation is controlled by an automatically adjusted electric amperage proportional in magnitude to the engine rpm. Such a design obviates the problems associated with lag time and can more accurately respond to the throttle commands of the operator. The electric compressor is designed to accommodate an existing street motorcycle or off-road motorcycles. The electric compressor may be easily installed between the motorcycle air filter and carburetor of the motorcycle. The compressor rotor is driven by an electric motor. The drive means may include a gear or chain mechanism, however, the preferred embodiment uses belt driver that runs on a drive wheel attached to the electric motor axle. The belt driver is connected to and drives at rotor wheel attached to the rotor axle.

SUMMARY OF THE INVENTION

It is therefore an objective of this invention to provide an electric powered compressor for increasing the intake air pressure entering a carburetor or cylinder of a conventional motorcycle internal combustion engine.

It is further an objective of this invention to provide an electric powered compressor for the intake air of an internal combustion motorcycle engine having an rpm at all times directly proportional to the rpm of the motorcycle engines.

It is still further an objective of this invention to provide an electric powered compressor for motorcycle engines being compact in size and capable of being installed in a conventional off-road motorcycle engine or street motorcycle engine.

These as well as other objectives are accomplished by an electrically operated compressor having an rpm output proportional to the engine rpm. The electric compressor may be installed between the air filter and carburetor of the motorcycle. The compressor rotor induces axial-flow air compression of the intake air along the length of the rotor axle which is centrally located within a cylindrical compressor chamber housing prior. The rotor is driven by an electric motor having a drive wheel and belt driver. In the preferred embodiment, the electric motor is located just outside the compressor chamber housing to avoid air flow obstruction. A drive wheel located on the electric motor axle turns a belt driver which in turn drives the compressor rotor wheel which is attached to the rotor axle. The compressor wheel is rotationally fixed to the rotor axle and rotates in union with the rotor axle. The compressor rotor fan blades are designed to compress the intake air as it passes from the filter to the carburetor or cylinder.

The compressor is always rotating so long as the engine alternator is operating, the rotor rpm being regulated by the engine rpm. When the compressor rotor is operating, additional fuel combustion in the cylinder is possible provided there is the addition of fuel introduced from the carburetor to the cylinder. To maximize the use of the electric powered compressor, the carburetor of the engine may require re-jetting of the fuel intake in order to provide the proper fuel-air ratio increase for a boost in power.

The electric motor power supply originates from electricity generated by an electricity generating coil secured to the alternator of the motorcycle engine. The electricity generating coil generates an alternating current which is converted to direct current by a rectifier. If the electricity generating coil does not produce a current sufficient for the desired operation of the electric motor, a transformer unit may be necessary to boost the current. The direct current generated is fed to the electric motor by means of the electric motor wires. The amperage of the electric current in the electric motor wires is regulated by the engine rpm, because the alternating current is generated by the electricity generating coil.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
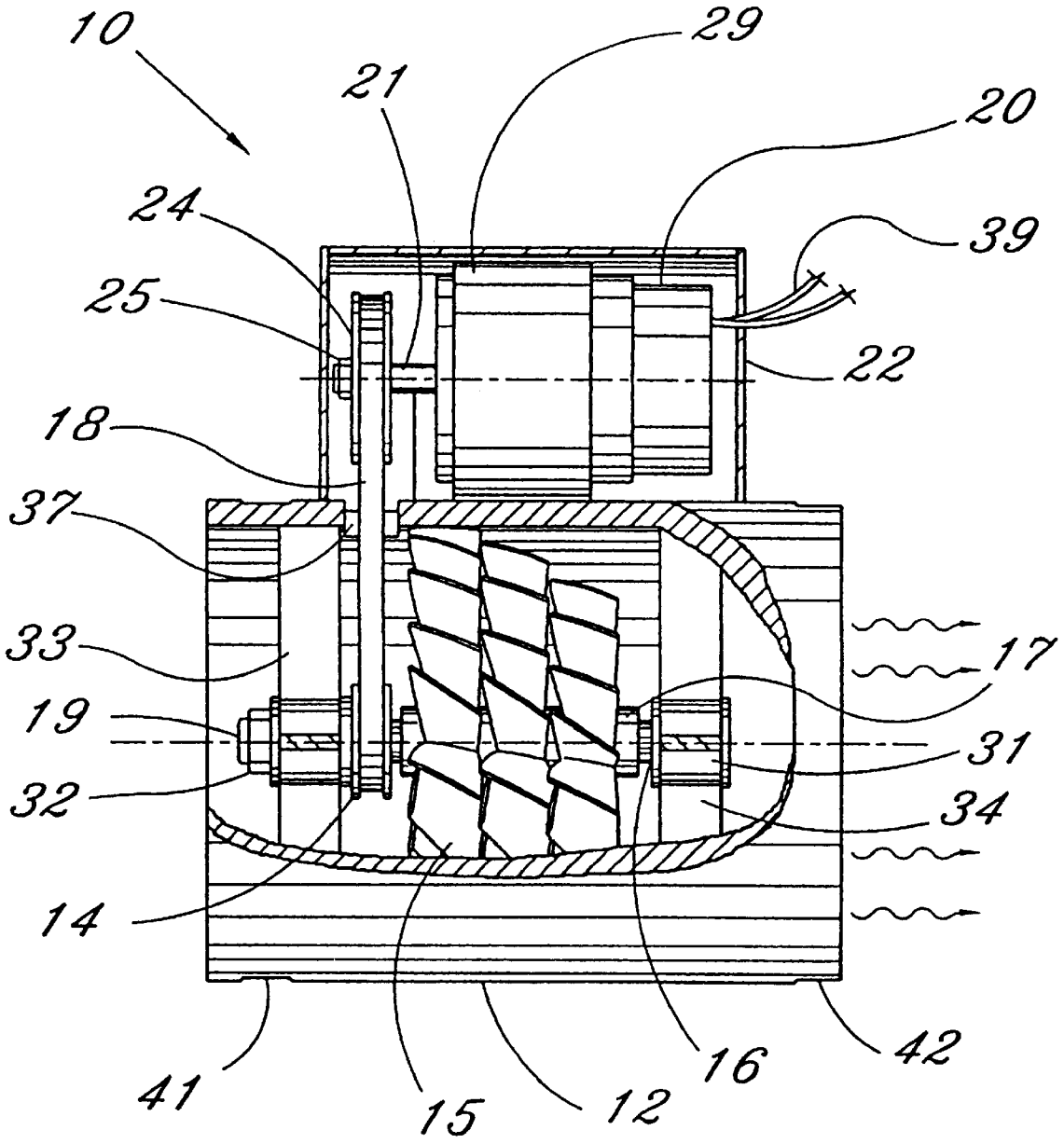
FIG. 1 of the drawings is a side view of the electric powered compressor with a cut-away view showing the internal components of the invention.
Figure 2:
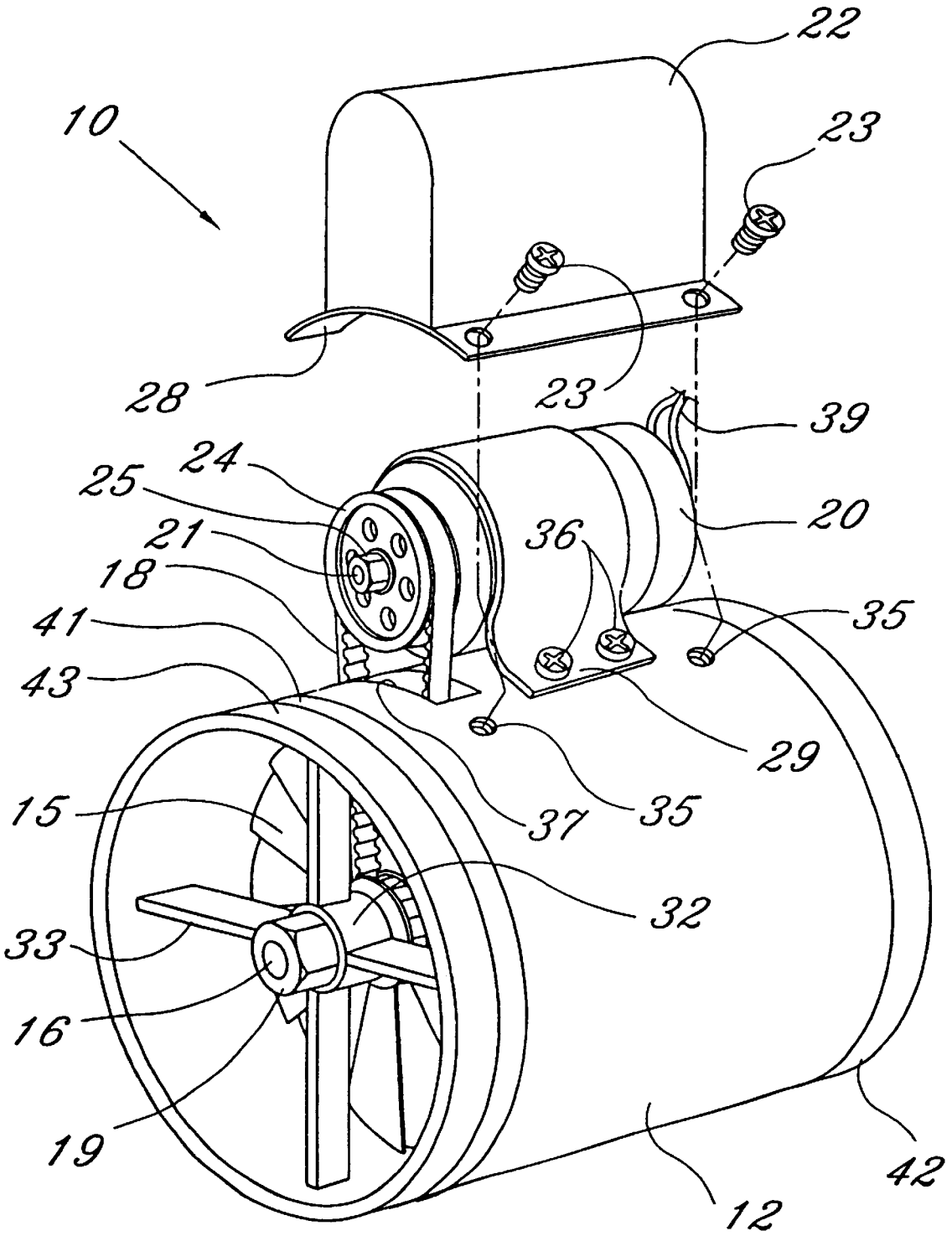
FIG. 2 of the drawings is a perspective view of the electric powered compressor.

Referring to the drawings by numerals of reference, there is shown in FIGS. 1, 2, 3 and 4 the electric powered compressor (10) for a motorcycle engine. Referring to FIGS. 1 and 2, the electric powered compressor (10) is shown having a compressor rotor (15) enclosed within a tubular compressor chamber housing (12). The electric motor (29) is mounted outside the compressor chamber housing (12) and communicates with the compressor rotor (15) by means of a belt driver (18). The compressor rotor (15) is fixed to a rotor axle (16) by a rotor sleeve (17), the entire compressor rotor (15) being secured to the center of the compressor chamber housing (12) by means of a first and second axle guide (32) and (31) and associated first and second guide braces (33) and (34).

Continuing to refer to FIGS. 1 and 2, the compressor rotor (15) is engaged by a belt driver (18) connected to the electric motor (20). The electric motor (20) is mounted to the compressor chamber housing (12) by a motor mount (29). The electric motor (20) communicates with the compressor rotor (15) by means of a drive wheel (24) attached to the electric motor axle (21) and is secured in place by a drive wheel nut (25). The belt driver (18) extends through the body of the compressor chamber housing (12) via the belt driver slot (37) and turns the rotor wheel (14) which in turn is secured to the rotor axle (16). The compressor rotor (15) is designed with fan blades that advance and compress the intake air from the carburetor (63) and ultimately into the cylinder (61) as shown in FIG. 4.

Figure 3:
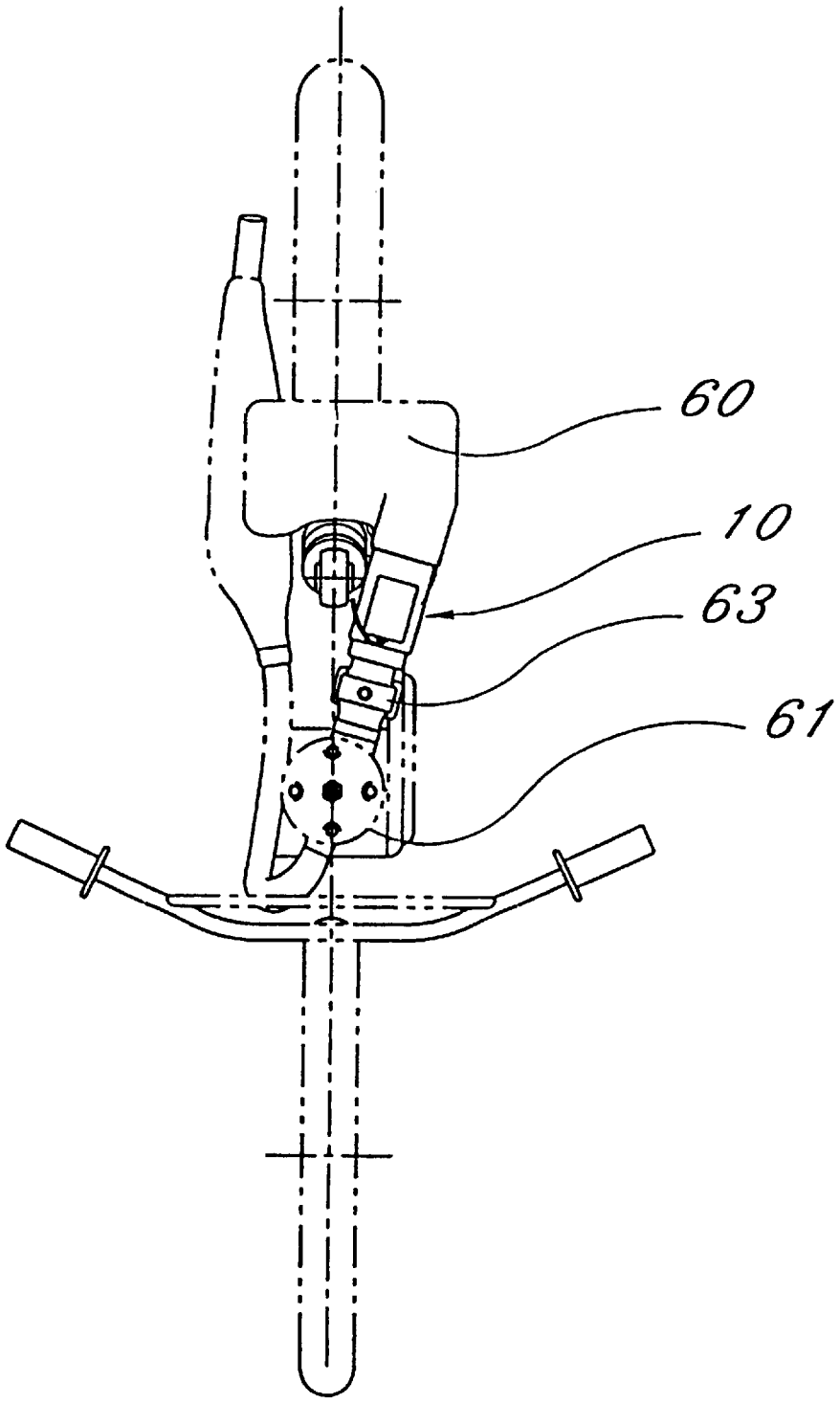
FIG. 3 of the drawings is a plan view of the top portion of a standard motorcycle showing the placement of the electric powered compressor.

Referring to FIG. 2, a perspective view of the electric compressor (10) is provided showing a cut-away view of the electric motor cover (22) which is designed to protect the electric motor (20) from the elements. Cover screws (23) are used to secure the motor cover (22) in place over the electric motor (20) and motor mount (29) which is secured to the compressor chamber housing (12) by means of mount screws (36). The air filter attachment end (43) of the compressor chamber housing (12) can be attached to the air filter (60), as shown in FIG. 3, by means of a filter end attachment grove (41). A similar attachment means to the carburetor intake is provided by the carburetor attachment end (42) of the compressor chamber housing (12).

The rpm of the compressor rotor (15) is determined by both the variable rpm of the electric motor (20) and the circumferential ratio between the drive wheel (24) and the rotor wheel (14). The preferred embodiment of the present invention provides a 2:1 ratio of rotor wheel (14) rotations to drive wheel (24) rotations. This ratio is established by empirical data and is a function of the electric motor (20) size and rpm capacity, the magnitude of electric amperage transmitted to the electric motor (20), and the desired rpm of the rotor compressor (15).

Figure 4:
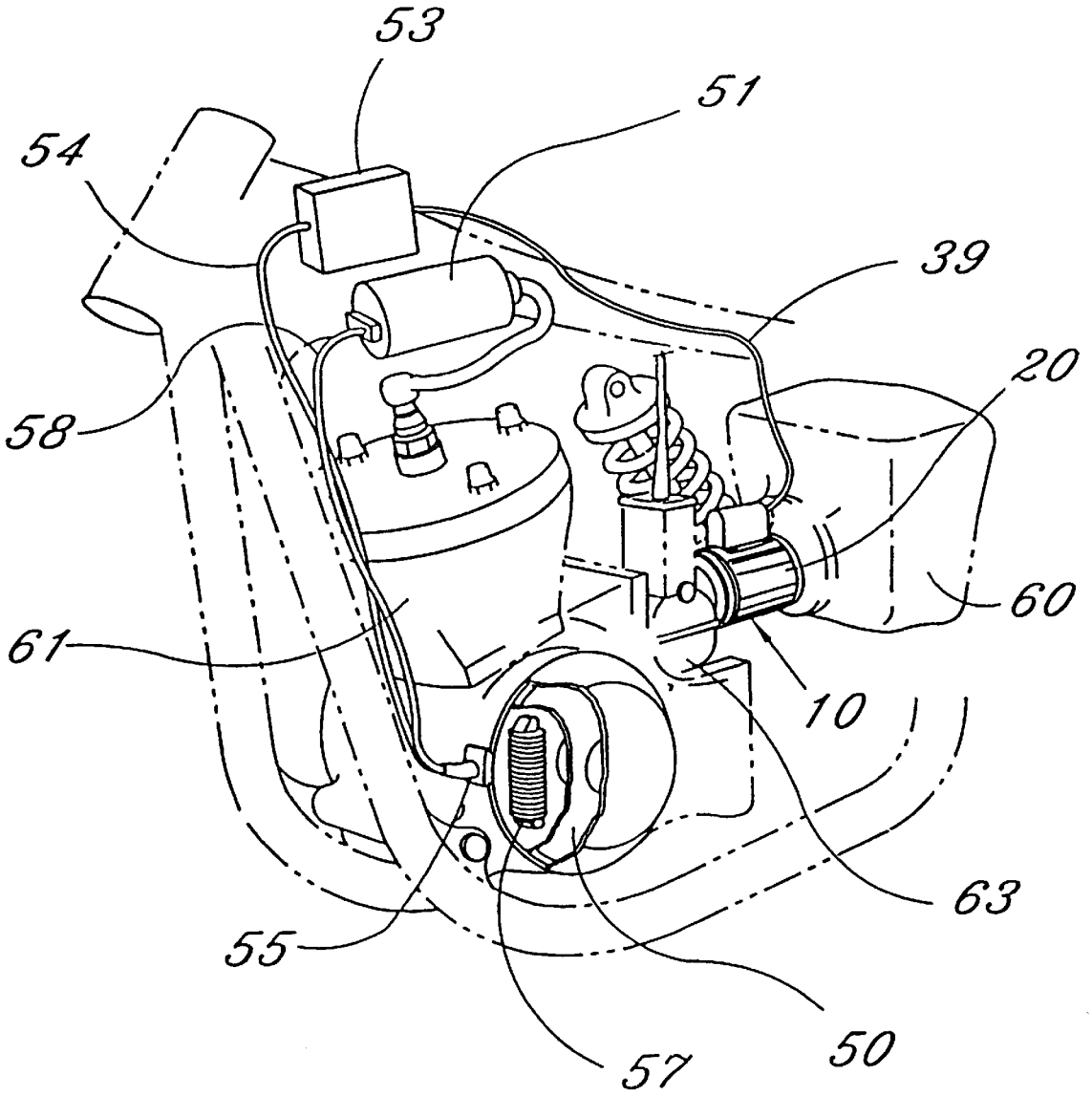
FIG. 4 of the drawings is a perspective view of a standard motorcycle engine showing the placement of the electric powered compressor and associated wiring.

Referring to FIGS. 3 and 4 the installation and placement of the electric compressor (10) on a standard off-road motorcycle. The preferred embodiment of the present invention places the electric compressor (10) between the air filter (60) outlet and the carburetor (63) intake. Typically, this space is occupied by a flexible duct which can easily be severed and the electric compressor (10) installed by a circular clamping means secured around the opposite ends of the compressor chamber housing (12) as depicted in FIGS. 1 and 2.

Referring to FIG. 4, the variable electric amperage to the electric motor (20) is provided by electric motor wires (39). The electric current created by the engine alternator (50) is an alternating current similar to the current transmitted through the ignition wire (58) to the ignition coil (51). The alternating current created by the added electricity generating coil (57) is conveyed to a rectifier transformer (53) via a power wire (54). The rectifier transformer (53) converts the alternating current to direct current and boosts the amperage, if necessary, to run the electric motor (20) which powers the electric compressor (10). The alternating current created by the electricity generating coil (57) is proportional to the rpm of the engine motor created by the operation of the cylinder (61).

The advantage of the described direct relationship between engine rpm and electric compressor operation is that the increased air compression created by the electric compressor (10) is almost instantaneous in reaction to the increased rpm created by the piston and cylinder (61) cycle. This obviates the undesirable lag time response common with typical turbocharger systems.

A preferred embodiment of the present invention is described herein. It is to be understood, of course, that changes and modifications may be made in the embodiment without departing from the true scope and spirit of the present invention as defined by the appended claims.

That which is claimed is:

1. An electrically powered compressor for compressing air which enters a combustion cylinder of an internal combustion engine of a motorcycle, comprising a compressor rotor having a plurality of compressor blades, wherein said compressor is positioned within a compressor chamber housing;

an electric motor which provides a rotational motion, wherein said electric motor is mounted outside of said compressor chamber housing and said rotational motion is transferred from said electric motor to said compressor rotor, wherein said compressor rotor induces an axial-flow air compression within said compressor chamber housing in a direction consonant with normal air intake flow;

a source of electrical current which is powered by said internal combustion engine.

2. The electrically powered compressor according to claim 1, wherein said source of electric current conveys electricity to said electric motor during operation of said internal combustion engine proportional in magnitude to the rotational speed of said internal combustion engine.

3. The electrically powered compressor according to claim 1, wherein said rotational motion is transferred from said electric motor to said compressor rotor by a drive apparatus comprising:

a drive wheel attached to an axle of said electric motor;

a rotor wheel which communicates with said compressor rotor, whereby rotation of said rotor wheel drives said compressor rotor; and a drive belt being secured to both said drive wheel and said rotor wheel, said drive belt passing through a belt drive slot in said compressor chamber housing, said drive belt causing said rotor wheel to rotate when said drive wheel is caused to rotate by means of said rotational motion of said electric motor.

4. The electrically powered compressor according to claim 2 wherein said source of said electrical current comprises:

an alternator of said internal combustion engine;

an electricity generating coil attached to said alternator for inducing an alternating current;

a rectifier which converts said alternating current to direct current for use by said electric motor; and a conductor for conveying electricity from said alternator through said rectifier to said electric motor.

5. The electrically powered compressor according to claim 1, further comprising an electricity generating coil attached to an alternator of said internal combustion engine for generating electricity from said alternator, said alternator operating in concert with the rotational speed of said internal combustion engine, whereby an increase in the rotational speed causes an increase in said amperage magnitude of electricity resulting in a corresponding increase in the rotational speed of said compressor rotor and an increase in the magnitude of axial-flow air compression within said compressor chamber housing.

6. The electrically powered compressor according to claim 1, wherein said compressor chamber housing comprises a carburetor attachment end and an air filter attachment end for installation along an air intake pathway between an air filter and carburetor of said internal combustion engine.

7. An electrically powered compressor for compressing air which enters a combustion cylinder of an internal combustion engine of a motorcycle, comprising a compressor rotor having a plurality of compressor blades, wherein said compressor is positioned within a compressor chamber housing;

an electric motor which provides a rotational motion, wherein said electric motor is mounted outside of said compressor chamber housing and said rotational motion is transferred from said electric motor to said compressor rotor, wherein said compressor rotor induces an axial-flow air compression within said compressor chamber housing in a direction consonant with normal air intake flow;

a source of electrical current which is powered by said internal combustion engine; and wherein said source of electric current conveys electricity to said electric motor during operation of said internal combustion engine proportional in magnitude to the rotational speed of said internal combustion engine.

8. The electrically powered compressor according to claim 7, wherein said source of said electrical current comprises:

an alternator of said internal combustion engine;

an electricity generating coil attached to said alternator for inducing an alternating current;

a rectifier which converts said alternating current to direct current for use by said electric motor; and a conductor for conveying electricity from said alternator through said rectifier to said electric motor.

9. The electrically powered compressor according to claim 7, further comprising an electricity generating coil attached to an alternator of said internal combustion engine for generating electricity from said alternator, said alternator operating in concert with the rotational speed of said internal combustion engine, whereby an increase in the rotational speed causes an increase in said amperage magnitude of electricity resulting in a corresponding increase in the rotational speed of said compressor rotor and an increase in the magnitude of axial-flow air compression within said compressor chamber housing.

10. The electrically powered compressor according to claim 7 wherein said compressor chamber housing comprises a carburetor attachment end and an air filter attachment end for installation along an air intake pathway between an air filter and carburetor of said internal combustion engine.

* * * * *